US009707780B1

(12) United States Patent
Takahashi et al.

(10) Patent No.: US 9,707,780 B1
(45) Date of Patent: Jul. 18, 2017

(54) PRINTING DEVICE CAPABLE OF SWITCHING PRINTING METHOD

(71) Applicant: Brother Kogyo Kabushiki Kaisha, Nagoya-shi, Aichi-ken (JP)

(72) Inventors: Toshihiro Takahashi, Nagoya (JP); Jumpei Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/267,171

(22) Filed: Sep. 16, 2016

(30) Foreign Application Priority Data

Dec. 23, 2015 (JP) ..... 2015-250747

(51) Int. Cl.
*B41J 13/00* (2006.01)
*B41J 2/32* (2006.01)

(52) U.S. Cl.
CPC ..... *B41J 13/0009* (2013.01); *B41J 2/32* (2013.01)

(58) Field of Classification Search
CPC ..... B41J 15/046; B41J 15/044; B41J 15/04; B41J 15/00; B41J 15/048; B41J 15/16; B41J 11/42; B41J 11/0095
See application file for complete search history.

(56) References Cited

U.S. PATENT DOCUMENTS 5,917,727 A * 6/1999 Richardson ..... B41J 13/0027 271/227
2006/0115313 A1* 6/2006 Shaw, III ..... B41J 15/04 400/621
2012/0082500 A1* 4/2012 Noguchi ..... B41J 15/04 400/582

FOREIGN PATENT DOCUMENTS

JP 2014-233930 A 12/2014

* cited by examiner

*Primary Examiner* — Kristal Feggins
(74) *Attorney, Agent, or Firm* — Banner & Witcoff, Ltd.

(57) ABSTRACT

A printing device includes a roller; a stepper motor; a head; and a controller. The roller is for conveying a printing medium in a conveying direction. The stepper motor is configured to rotate in synchronization with a pulse signal and rotate the roller. The head is configured to perform printing on the printing medium conveyed by the roller. The controller is configured to perform: decelerating the stepper motor from a first speed to a second speed; identifying a rotational speed of the stepper motor during deceleration of the stepper motor; performing synchronous printing in which the head is driven at timing in synchronization with the pulse signal when the rotational speed is greater than or equal to a prescribed speed; and performing timer printing in which the head is driven at a prescribed period when the rotational speed is less than the prescribed speed.

7 Claims, 9 Drawing Sheets

PRINTING DEVICE CAPABLE OF SWITCHING PRINTING METHOD

CROSS REFERENCE TO RELATED APPLICATION

This application claims priority from Japanese Patent Application No. 2015-250747 filed on Dec. 23, 2015. The entire content of the priority application is incorporated herein by reference.

TECHNICAL FIELD

The present disclosure relates to a printing device.

BACKGROUND

A printing device capable of printing on tape, tubing, and the like is well known in the art. A tape-printing device described in Japanese Patent Application Publication. No. 2014-233930 employs a DC motor to drive a tape-conveying roller. When power is supplied to the DC motor, the motor rotates the tape-conveying roller, and the roller conveys a surface layer tape and an ink ribbon simultaneously. The tape-printing device also includes a thermal head having a plurality of heating elements. Electricity is conducted to the heating elements as the surface layer tape and ink ribbon are conveyed, causing ink to be transferred in units of dots from the ink ribbon to the surface layer tape. The timing for transferring the dots is synchronized with a pulse signal outputted from an encoder mounted on the DC motor. Hereinafter, this style of printing method will be called "synchronous printing." Thus, the tape-printing device prints surface layer tape according to synchronous printing.

During the course of the printing process, printing and conveyance may be temporarily halted and subsequently resumed. When the supply of power to the DC motor is halted, causing the DC motor to decelerate, the rotational speed of the DC motor may diverge from the conveying speed of the tape conveyed by the roller as the tape-conveying roller continues to rotate due to inertia. When synchronous printing is performed continuously during such cases, undesirable white lines (areas in which dots are not formed) may be produced. In light of this, the conventional tape-printing device described above determines whether the rotational speed of the DC motor has diverged from the tape conveying speed based on the pulse period of the pulse signal outputted from the encoder. The tape-printing device continues to execute synchronous printing while the period of the pulse signal does not meet a prescribed condition. However, when the period of the pulse signal meets the prescribed condition, the tape-printing device switches from synchronous printing to timer printing for transferring dots at a prescribed period.

SUMMARY

A stepper motor may be used in place of the DC motor for driving the tape-conveying roller since the stepper motor is capable of performing faster rotational control. When the tape conveying speed on this printing device is faster than the conventional device provided with a DC motor, the speed of the stepper motor is decreased more sharply in order to temporarily halt printing and conveyance than when using a DC motor. Consequently, the discrepancy between the rotational speed of the stepper motor and the conveying speed of the tape is much greater than with the conventional device having a DC motor. Thus, it is more difficult to determine a precise timing for switching the method of printing from synchronous printing to timer printing.

In view of the foregoing, it is an object of the present disclosure to provide a printing device capable of switching the printing method from synchronous printing to timer printing at suitable timing.

In order to attain the above and other objects, one aspect provides a printing device that includes a roller; a stepper motor; a head; and a controller. The roller is for conveying a printing medium in a conveying direction. The stepper motor is configured to rotate in synchronization with a pulse signal and rotate the roller. The head is configured to perform printing on the printing medium conveyed by the roller. The controller is configured to perform: decelerating the stepper motor from a first speed to a second speed; identifying a rotational speed of the stepper motor during deceleration of the stepper motor; performing synchronous printing in which the head is driven at timing in synchronization with the pulse signal when the rotational speed is greater than or equal to a prescribed speed; and performing timer printing in which the head is driven at a prescribed period when the rotational speed is less than the prescribed speed.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
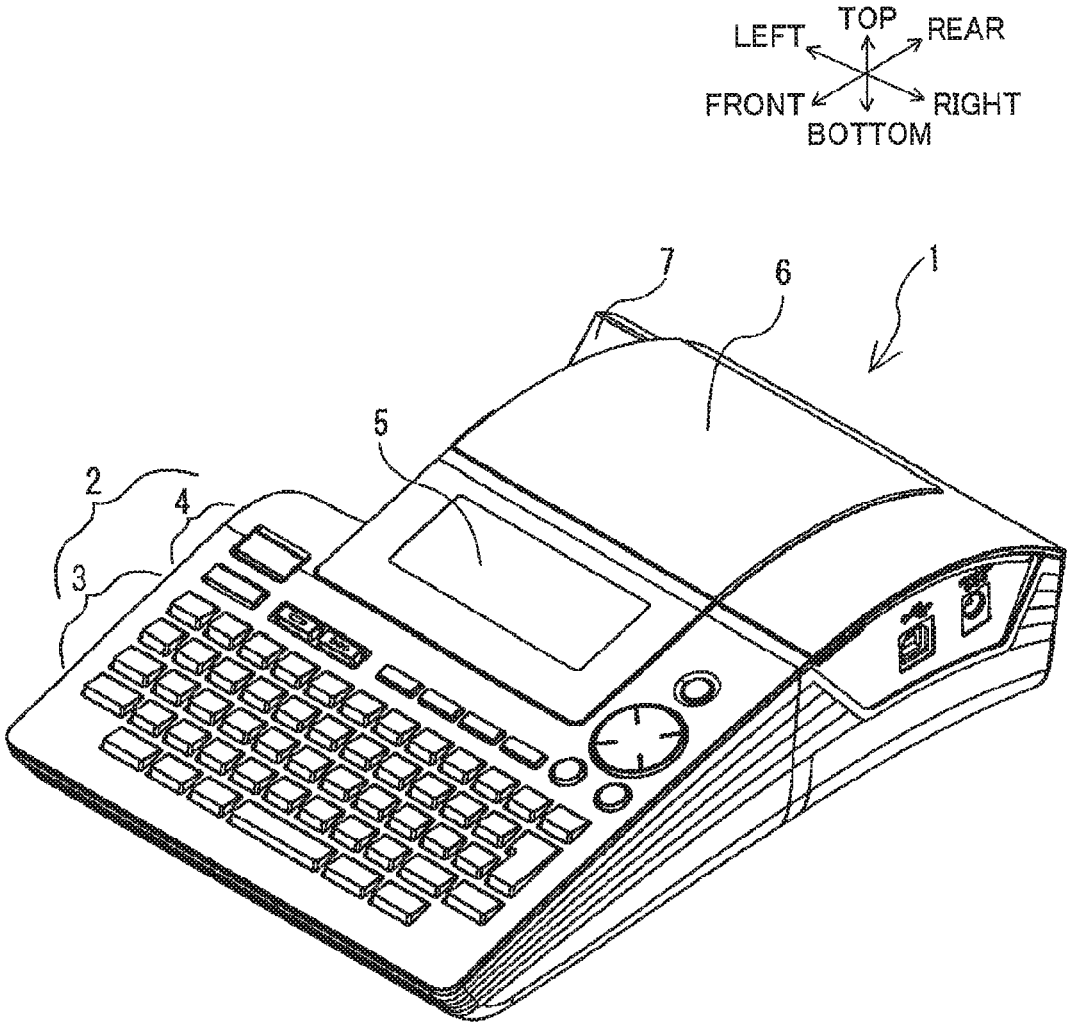
FIG. 1 shows a perspective view of a printing device according to an embodiment of the present disclosure when a cover closes on the printing device.

An embodiment of the present disclosure will be described while referring to the accompanying drawings.

The drawings referred to are used merely to explain technical features that the present disclosure can employ. Device configurations and the like shown in the drawings are mere examples for description and should not be construed as limiting the disclosure.

<Overall Configuration of a Printing Device 1 and a Tape Cassette 30>

The overall configuration of a printing device 1 and a tape cassette 30 will be described with reference to FIGS. 1 through 3. In the following description, the upper-right side of the printing device 1 in FIGS. 1 and 2 will be called the rear side, the lower-left side will be called the front side, the lower-right side will be called the right side, the upper-left side will be called the left side, the top side will be called the top side, and the bottom side will be called the bottom side. As shown in FIG. 1, a keyboard 3 is disposed on the top surface of the printing device 1 to allow the input of characters (letters, numbers, symbols, etc.). A functional key group 4 is provided to the rear side (the upper-right side in FIG. 1) of the keyboard 3. The functional key group 4 includes a power switch, mode keys, and cursor keys. In the following description, the keyboard 3 and functional key group 4 may be collectively referred to as an operating unit 2. A display 5 is provided on the rear side of the functional key group 4. A cover 6 is provided on the top surface of the printing device 1. The cover 6 constitutes the rear portion of the top surface and is positioned to the rear of the display 5. The cover 6 can open and close on the printing device 1. A tape tray 7 is provided in the left-rear corner of the printing device 1. The tape tray 7 receives tape that has been printed and subsequently cut by a cutter 36 described later (see FIG. 3).

Figure 2:
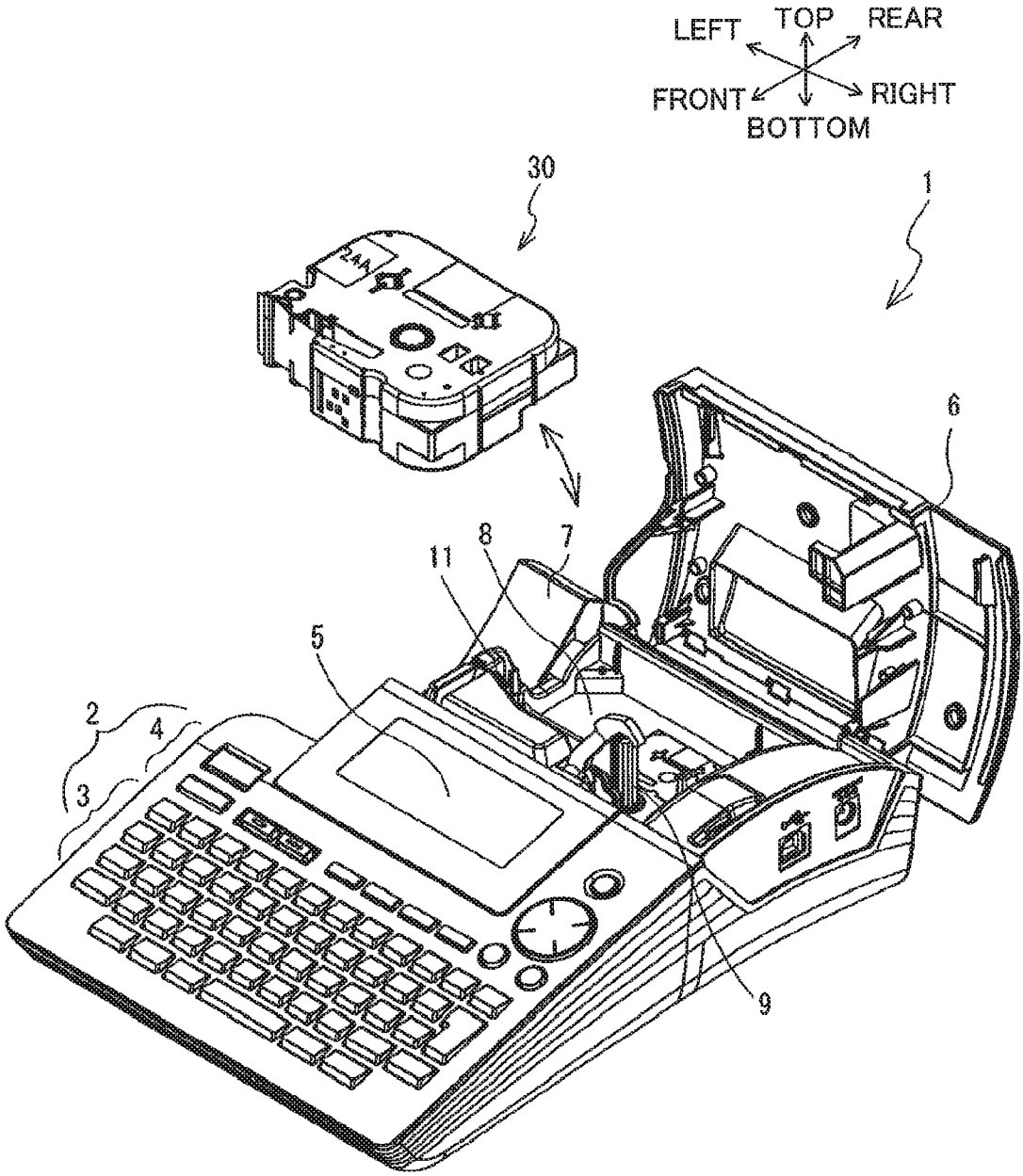
FIG. 2 shows perspective views of the printing device when the cover opens on the printing device and a tape cassette to be mounted in the printing device.

As shown in FIG. 2, a cartridge-mounting section 8 is formed on the rear side of the display 5. The tape cassette 30 is detachably mounted in the cartridge-mounting section 8. The printing device 1 uses the tape cassette 30 mounted in the cartridge-mounting section 8 to print characters inputted via the keyboard 3. Within the cartridge-mounting section 8 are provided a ribbon take-up shaft 9, a tape-driving shaft 11, a thermal head 10 (see FIG. 3), a platen roller 37 (see FIG. 3), a pressure roller 38 (see FIG. 3), and the like. A cutter 36 (see FIG. 3) is also provided on the left side of the thermal head 10.

Figure 3:
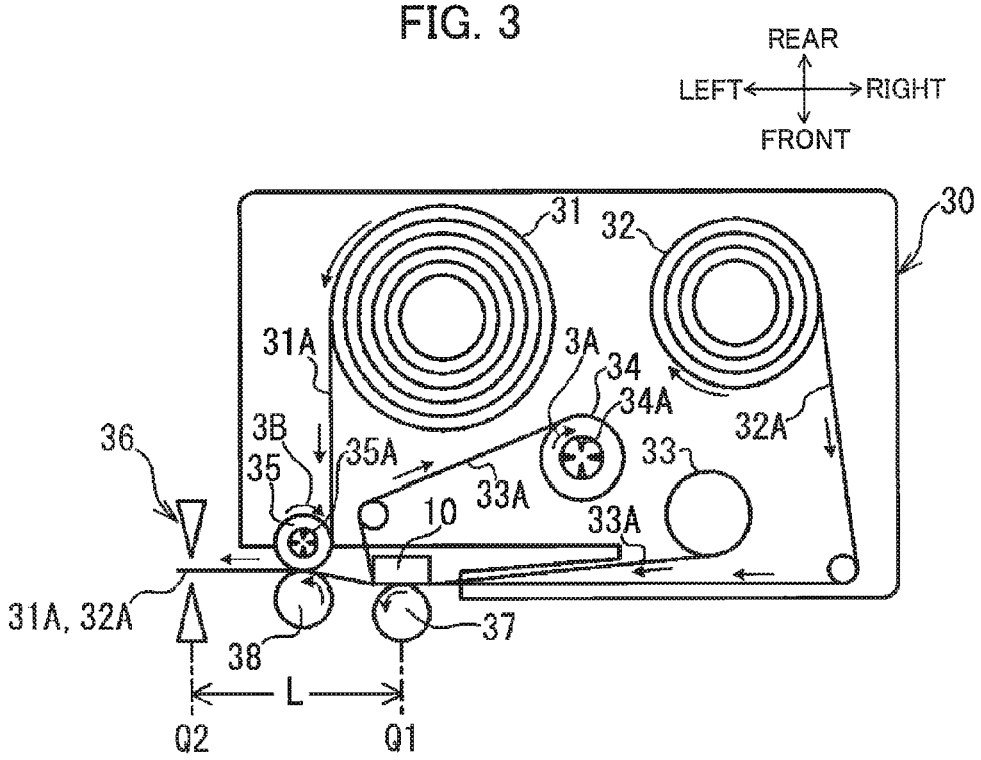
FIG. 3 is a schematic diagram of the tape cassette.

As shown in FIG. 3, the tape cassette 30 has a first roll 31, a second roll 32, a ribbon supply-side roll 33, a ribbon take-up roller 34, and a tape-feeding roller 35. A base tape 31A is wound around the first roll 31. A cover film 32A is wound around the second roll 32. An ink ribbon 33A is wound around the ribbon supply-side roll 33. After use, the ink ribbon 33A is subsequently wound about the ribbon take-up roller 34. When the tape cassette 30 is mounted in the cartridge-mounting section 8, a gear 34A provided along the inner surface of the ribbon take-up roller 34 is fitted over a gear provided around the outer surface of the ribbon take-up shaft 9 (see FIG. 2); and a gear 35A provided along the inner surface of the tape-feeding roller 35 is fitted over a gear provided along the outer surface of the tape-driving shaft 11 (see FIG. 2). The cover film 32A and ink ribbon 33A are pinched between the thermal head 10 and platen roller 37. Further, the base tape 31A and cover film 32A are pinched between the tape-feeding roller 35 and pressure roller 38. The tape-feeding roller 35 is an example of the claimed roller.

<Electrical Configuration of the Printing Device 1>

Figure 4:
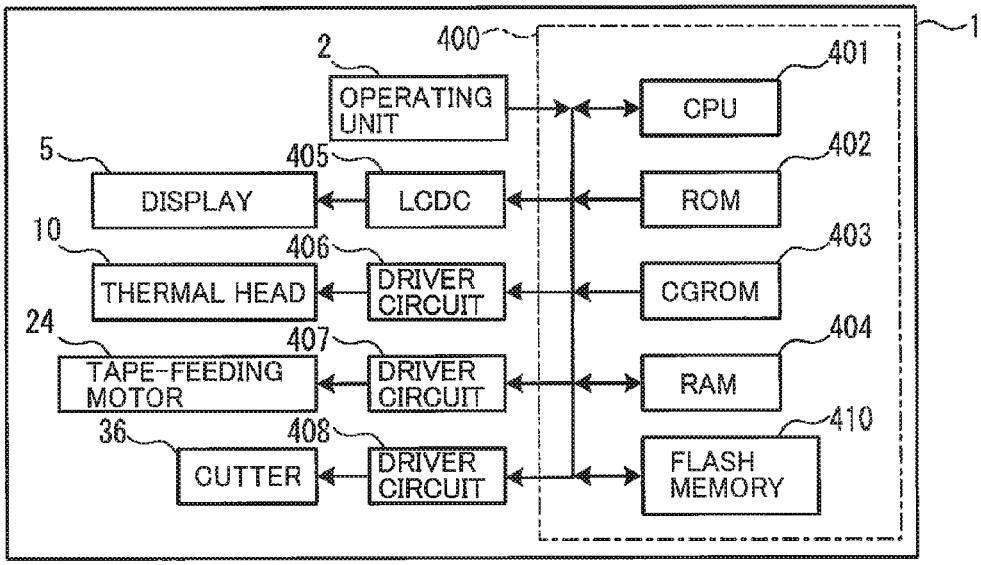
FIG. 4 is a block diagram showing an electrical structure of the printing device.

Next, the electrical structure of the printing device 1 will be described with reference to FIG. 4. The printing device 1 includes a control circuit 400 formed on a control board. The control circuit 400 includes a central processing unit (CPU) 401, a read-only memory (ROM) 402, a character generator read-only memory (CGROM) 403, a random access memory (RAM) 404, and a flash memory 410, all of which components are interconnected via a data bus.

The ROM 402 stores various parameters required when the CPU 401 executes programs. The CGROM 403 stores dot pattern data for printing characters. The RAM 404 is provided with a plurality of storage areas, including a text memory area and a print buffer. The flash memory 410 stores the various programs that the CPU 401 executes in order to control the printing device 1. Note that these programs stored on the flash memory 410 may be also acquired from an external device via an interface device (not shown). When the CPU 401 acquires programs from an external device, the CPU 401 may replace the programs stored in the flash memory 410 with the acquired programs. The flash memory 410 additionally stores print data and pulse data (during deceleration and acceleration) described later. The CPU 401 is an example of the claimed controller.

The printing device 1 further includes the operating unit 2 described above, a liquid crystal drive circuit (LCDC) 405, and driver circuits 406, 407, and 408 that are all connected to the control circuit 400 and CPU 401 in the control circuit 400. The LCDC 405 has a video RAM (not shown) for outputting display data to the display 5. The driver circuit 406 is a circuit that drives the thermal head 10. The CPU 401 outputs a control signal to the driver circuit 406 for controlling the driver circuit 406 to switch electrical conduction to a plurality of heating elements in the thermal head 10 on and off. The printing device 1 is also provided with a tape-feeding motor 24. The tape-feeding motor 24 is a stepper motor that rotates the ribbon take-up shaft 9 and tape-driving shaft 11. The tape-feeding motor 24 is an example of the claimed stepper motor. A plurality of gears (hereinafter called "coupling gears") are interposed between the tape-feeding motor 24 and the ribbon take-up shaft 9 and tape-driving shaft 11 for coupling the tape-feeding motor 24 to the ribbon take-up shaft 9 and tape-driving shaft 11. The tape-feeding motor 24 rotates in synchronization with an inputted pulse signal. The tape-feeding motor 24 transmits a rotational drive force to the ribbon take-up shaft 9 and tape-driving shaft 11 via the coupling gears. The driver circuit 407 functions to drive the tape-feeding motor 24. The CPU 401 outputs a pulse signal to the driver circuit 407. The driver circuit 407 converts the power of the pulse signal outputted from the CPU 401 to power for driving the tape-feeding motor 24, and outputs the converted pulse signal to the tape-feeding motor 24. Thus, by outputting a pulse signal to the tape-feeding motor 24 via the driver circuit 407, the CPU 401 can rotate the tape-feeding motor 24 at a rotational speed corresponding to the pulse signal. The driver circuit 408 is an electronic circuit that drives the cutter 36. The CPU 401 controls the cutter 36 to cut tape by outputting a control signal to the driver circuit 408.

<Overview of Printing Operations for Normal Printing>

When the CPU 401 drives the tape-feeding motor 24 via the driver circuit 407, the ribbon take-up shaft 9 and tape-driving shaft 11 rotate in association with each other. As shown in FIG. 3, the ribbon take-up shaft 9 (see FIG. 1) rotates the ribbon take-up roller 34 in a direction indicated by an arrow 3A. The tape-driving shaft 11 (see FIG. 1) rotates the tape-feeding roller 35 in a direction indicated by an arrow 3B. In response to this rotation, the base tape 31A is unreeled from the first roll 31, the cover film 32A is unreeled from the second roll 32, and the ink ribbon 33A is unreeled from the ribbon supply-side roll 33. Hereinafter, the base tape 31A and cover film 32A will be collectively called the "tape."

The platen roller 37 rotates as the tape-feeding roller 35 conveys tape. The platen roller 37 presses the cover film 32A unreeled from the second roll 32 against the thermal head 10. The ink ribbon 33A is interposed between the cover film 32A and the thermal head 10. The CPU 401 supplies electricity to the plurality of heating elements in the thermal head 10. The heating elements generate heat when supplied with electricity, causing a plurality of dots of ink to be transferred from the ink ribbon 33A to the cover film 32A. Dots are repeatedly transferred onto the cover film 32A when the tape-feeding roller 35 conveys the cover film 32A, forming a particular pattern on the cover film 32A that comprises pluralities of dots juxtaposed in the conveying direction of the cover film 32A (a dot pattern). The dot pattern formed on the cover film 32A corresponds to characters inputted via the keyboard 3.

The pressure roller 38 also rotates while the tape-feeding roller 35 conveys tape. The tape-feeding roller 35 and pressure roller 38 apply pressure to the base tape 31A and the printed cover film 32A. As a result, the base tape 31A and cover film 32A are bonded together to form a single integrated tape with the base tape 31A laminated over the surface of the cover film 32A on which the dots were formed. The CPU 401 subsequently drives a cutter motor (not shown) to operate the cutter 36 disposed downstream of the tape-feeding roller 35 and pressure roller 38 in order to cut off an integrated portion of the base tape 31A and cover film 32A. Hereinafter, the portion of the tape cut by the cutter 36 will be called "printed tape." The tape tray 7 receives the printed tape. The used portion of the ink ribbon 33A is taken up by the ribbon take-up roller 34.

As described above, the CPU 401 supplies electricity to the heating elements of the thermal head 10 each time the rotated amount of the tape-feeding motor 24 calculated based on pulse signals outputted to the tape-feeding motor 24 via the driver circuit 407 increases by a prescribed amount. Through this process, the printing device 1 forms a plurality of dots on the cover film 32A as the cover film 32A is conveyed by the rotation of the tape-feeding motor 24. The dots are formed on the cover film 32A at intervals in the conveying direction. In other words, in this printing method the CPU 401 drives the heating elements of the thermal head 10 to form dots on the cover film 32A at timing based on pulse signals outputted to the tape-feeding motor 24. Hereinafter, this printing method will be called "synchronous printing."

In synchronous printing, the period at which dots are transferred varies according to the rotational speed of the tape-feeding motor 24. Thus the period used when dots are transferred increases when the rotational speed of the tape-feeding motor 24 slows. Here, when the changes in rotational speed of the tape-feeding motor 24 correspond to the changes in the conveying speed of the cover film 32A, dots are transferred onto the cover film 32A at timing corresponding to the conveying speed of the cover film 32A. In this case, the dots are formed at substantially uniform spacing in the conveying direction of the cover film 32A. However, as will be described later in greater detail, changes in the rotational speed of the tape-feeding motor 24 do not always correspond to the changes in conveying speed of the cover film 32A. When synchronous printing is executed in such cases, dots may not be formed on the cover film 32A with uniform spacing in the conveying direction.

<Overview of Printing Operations (Segment Printing)>

In the printing device 1 shown in FIG. 3, a printing position Q1 at which the thermal head 10 prints is separated from a cutting position Q2 at which the cutter 36 cuts by a gap in the conveying direction equivalent to a distance L. This gap of distance L generates a blank leader substantially equivalent to the distance L at the start of the printed tape. When it is desirable to create printed tape with a short leader, the printing device 1 must halt rotation of the tape-feeding motor 24 during the printing operation to temporarily halt tape conveyance, cut the blank leader from the printed tape in this halted state, and subsequently resume printing by again driving the tape-feeding motor 24. This type of printing is generally called "segment printing."

<Detailed Description of Segment Printing (Temporary Halting Control)>

The following describes an example of reducing the speed of the tape-feeding motor 24 in order to temporarily halt tape conveyance when executing segment printing. When the tape-feeding roller 35 decelerates in response to deceleration of the tape-feeding motor 24, the change in rotational speed of the tape-feeding motor 24 does not always correspond to the change in conveying speed of the cover film 32A. The following is a detailed description of two specific factors that cause the speeds of the tape-feeding motor 24 and cover film 32A to diverge.

The first factor is the effect of backlash among the coupling gears interposed between the tape-feeding motor 24 and tape-driving shaft 11. When the tape-feeding motor 24 decelerates, the tape-driving shaft 11 and tape-feeding roller 35 may rotate more than the tape-feeding motor 24 by an amount equivalent to backlash among the coupling gears. When affected by such backlash, the conveyance amount of the cover film 32A per unit time is greater than the conveyance amount of the cover film 32A per unit time when the effects of backlash are excluded. Here, the conveyance amount of the cover film 32A per unit time when the effects of backlash are excluded corresponds to the rotational speed of the tape-feeding motor 24.

The second factor is the effect of deflection in the tape-feeding roller 35. When tape is conveyed, a force opposite the conveying direction is applied to the portion of the tape-feeding roller 35 contacting the tape. This force causes the tape-feeding roller 35 to deflect. The force responsible for deflection increases as the rotational speed of the tape-feeding roller 35 increases. Therefore, the amount of deflection lessens when the tape-feeding roller 35 decelerates since the force causing deflection decreases. The tape-feeding roller 35 conveys the tape interposed between the tape-feeding roller 35 and pressure roller 38 in the conveying direction in association with this decrease in deflection. Accordingly, the tape conveying speed may temporarily increase when the tape-feeding motor 24 is decelerated.

A specific example will be described next with reference to FIG. 5A. In the following description, the conveying speed of the cover film 32A that ignores the effects from the above factors will be called the "conveying speed from the rotation of the tape-feeding motor 24." The conveying speed of the cover film 32A that accounts for the effects of the above factors will be called the "actual conveying speed." The bold line in the graph of FIG. 5A denotes the conveying speed from the rotation of the tape-feeding motor 24, and the dashed line denotes the actual conveying speed.

Figure 5A:
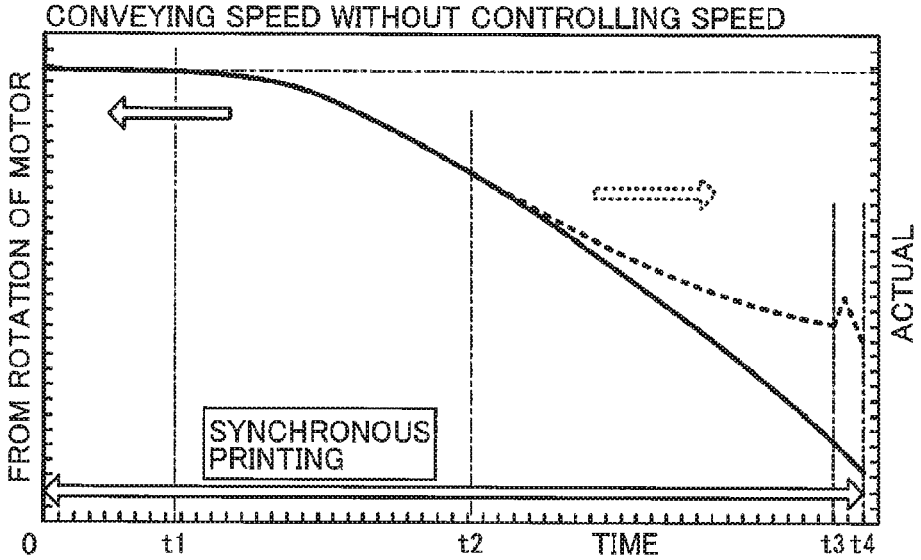
FIG. 5A is a graph showing conveying speed changes over time without controlling rotational speed of a tape-feeding motor in the printing device.

In the example of FIG. 5A, the tape-feeding motor 24 begins decelerating at timing U. Between timings t1 and t2, the actual conveying speed remains substantially equivalent to the conveying speed from the rotation of the tape-feeding motor 24. However, between timings t2 and t3 the actual conveying speed is faster than the conveying speed from the rotation of the tape-feeding motor 24 due to the first factor described above. Specifically, the tape-feeding roller 35 rotates more than the tape-feeding motor 24 due to the effects of backlash among the coupling gears. Consequently, the actual conveying speed becomes greater than the conveying speed from the rotation of the tape-feeding motor 24. Further, the rate of decrease per unit time of the conveying speed from the rotation of the tape-feeding motor 24 is greater than the rate of decrease per unit time of the actual conveying speed. Hence, the slope denoting the conveying speed from the rotation of the tape-feeding motor 24 is steeper than the slope denoting the actual conveying speed between timings t2 and t3.

Between timings t3 and t4, the actual conveying speed temporarily increases due to the second factor described above. Specifically, the force causing deflection in the tape-feeding roller 35 decreases as the actual conveying speed decreases along with the deceleration of the tape-feeding roller 35. Accordingly, deflection in the tape-feeding roller 35 lessens. The tape-feeding roller 35 conveys the tape in the conveying direction in association with this decrease in deflection, temporarily increasing the tape conveying speed. Consequently, the actual conveying speed temporarily increases before returning to its original speed between timings t3 and t4.

The above description provides an example of executing synchronous printing when the actual conveying speed becomes greater than the conveying speed from the rotation of the tape-feeding motor 24. In synchronous printing, the period at which dots are transferred onto the cover film 32A is adjusted according to the rotational speed of the tape-feeding motor 24. Hence, when the actual conveying speed becomes greater than the conveying speed from the rotation of the tape-feeding motor 24, the dots formed on the cover film 32A in synchronous printing become spaced wider apart in the conveying direction. This phenomenon may produce blank areas (white lines) extending in a direction orthogonal to the conveying direction in the dot pattern formed on the cover film 32A.

In the present embodiment, the CPU 401 controls the rotational speed of the tape-feeding motor 24 as follows after beginning to decelerate the tape-feeding motor 24 in order to suppress the generation of blank areas in the dot pattern. Hereinafter, the rotational speed of the tape-feeding motor 24 before deceleration is begun will be called the "first speed." Further, a prescribed speed slower than the first speed but faster than the rotational speed of the tape-feeding motor 24 during deceleration when the actual conveying speed temporarily increases due to deflection of the tape-feeding roller 35 (between timings t3 and t4 in FIGS. 5A and 5B) will be called the "second speed." In the examples of FIGS. 5B and 5C, deceleration of the tape-feeding motor 24 begins from timing t11 that is later than the timing t1.

Figure 5B:
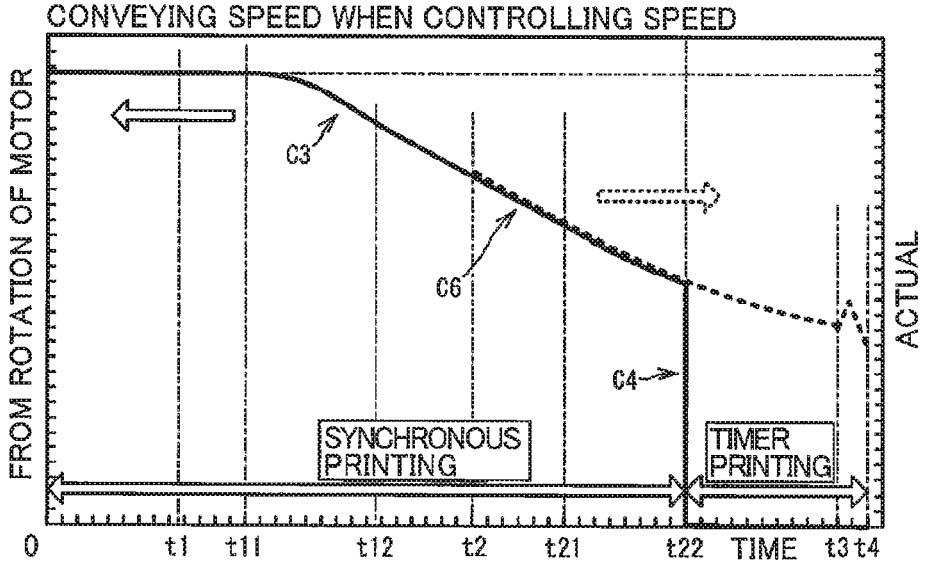
FIG. 5B is a graph showing conveying speed changes over time when controlling the rotational speed of the tape-feeding motor.
Figure 5C:
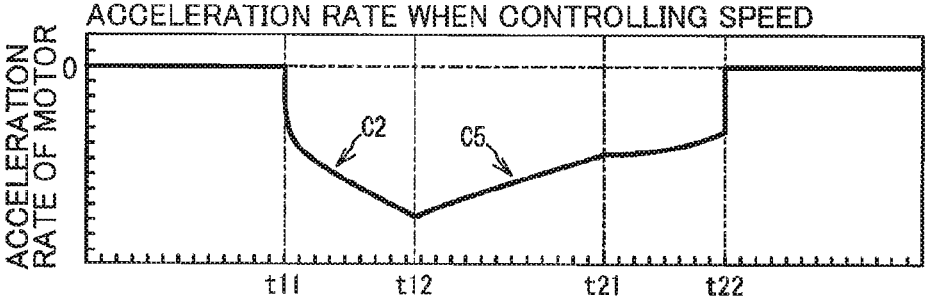
FIG. 5C is a graph showing acceleration rate changes over time when controlling the rotational speed of the tape-feeding motor.

As shown in FIG. 5C, the CPU 401 controls the tape-feeding motor 24 in order that the rate of decrease per unit time in the rotational speed of the tape-feeding motor 24 increases over time (curve C2) while the rotational speed of the tape-feeding motor 24 decreases from the first speed to a prescribed speed greater than the second speed (hereinafter called an "intermediate speed"; from timing t11 to timing t12). Through this control, the slope shown in FIG. 5B denoting the rate of decrease per unit time of the conveying speed from the rotation of the tape-feeding motor 24 becomes gradually steeper over time between timings t11 and t12 (curve C3).

Next, as illustrated in FIG. 5C, the CPU 401 controls the tape-feeding motor 24 so that the rate of decrease per unit time in the rotational speed of the tape-feeding motor 24 decreases over time (curve C5) between the intermediate speed and the second speed (between timings t12 and t22). The CPU 401 also changes the rate of decrease per unit time in the rotational speed of the tape-feeding motor 24 at timing t21 between timings t11 and t22. Beginning from timing t2, which is the timing at which the actual conveying speed begins to diverge from the conveying speed from the rotation of the tape-feeding motor 24 in FIG. 5A, the rotational speed of the tape-feeding motor 24 is increased from that in FIG. 5A. As shown in FIG. 5B, the actual conveying speed is approximately equal to the conveying speed from the rotation of the tape-feeding motor 24 even after timing t2 (curve C6). Thus, the CPU 401 prevents an increase in the spacing in the conveying direction among dots formed on the cover film 32A caused by a difference between the conveying speed from the rotation of the tape-feeding motor 24 and the actual conveying speed.

Note that the CPU 401 controls the rotational speed of the tape-feeding motor 24 as described above based on pulse data for deceleration stored in the flash memory 410. The pulse data for deceleration specifies the period of pulse signals to be outputted from the CPU 401 to the tape-feeding motor 24 via the driver circuit 407 for increments of elapsed time after deceleration of the tape-feeding motor 24 has begun. The rate of decrease per unit time in the rotational speed of the tape-feeding motor 24 is adjusted in the pulse data for deceleration such that the actual conveying speed becomes approximately equal to the conveying speed from the rotation of the tape-feeding motor 24 beginning from timing t2. The pulse data for deceleration is identified in advance by measuring rotational speeds of the tape-feeding motor 24 that correspond to actual conveying speeds.

As shown in FIG. 5B, the CPU 401 continues synchronous printing while the rotational speed of the tape-feeding motor 24 is at least the second speed (up to timing t22). When the rotational speed of the tape-feeding motor 24 is less than the second speed (beginning from timing t22), the CPU 401 switches the printing method from synchronous printing to timer printing and continues the printing operation according to timer printing. Timer printing is a printing technique that is not dependent on the rotational speed of the tape-feeding motor 24. In timer printing, the heating elements of the thermal head 10 are driven at a prescribed period to form dots on the cover film 32A. Note that the second speed is still greater than the rotational speed of the tape-feeding motor 24 when the actual conveying speed increases temporarily due to the deflection of the tape-feeding roller 35 described above (between timings t3 and t4). Accordingly, dots are still transferred onto the cover film 32A through timer printing when the actual conveying speed temporarily increases.

Further, when the rotational speed of the tape-feeding motor 24 is slower than the second speed, the CPU 401 halts the tape-feeding motor 24 in an excitation state (curve C4). In other words, the tape-feeding motor 24 is stopped in an energized state. Timer printing is thus executed while the tape-feeding motor 24 is in a halted state.

In timer printing, the CPU 401 sets the drive period for the heating elements in the thermal head 10 shorter than the drive period used when switching from synchronous printing to timer printing. With this control, the CPU 401 can suppress the formation of blank areas (white lines) among the dots formed on the cover film 32A after timing t22 when the actual conveying speed temporarily increases due to deflection of the tape-feeding roller 35.

Figure 6:
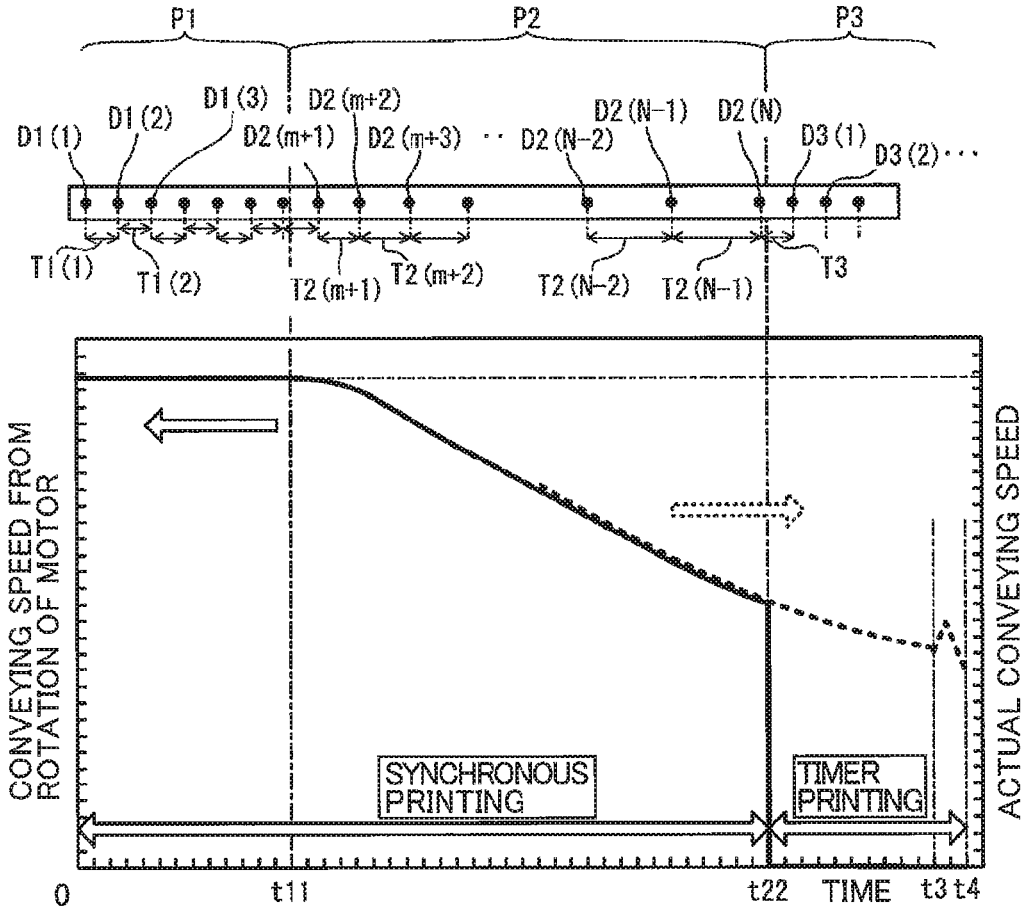
FIG. 6 is an explanatory diagram showing timing at which dots are transferred onto a cover film.

FIG. 6 shows the timing at which dots are transferred onto the cover film 32A in greater detail. The tape-feeding motor 24 rotates at the first speed during a period P1 that ends when deceleration of the tape-feeding motor 24 begins (timing t11). During this period P1, the driver circuit 407 outputs pulse signals to the tape-feeding motor 24 at a uniform period. Hence, when synchronous printing is executed during period P1, dots are formed on the cover film 32A at timing corresponding to a pulse signal having a regular period. Accordingly, a time T1(1) between formation of a first dot D1(1) and a second dot D1(2) is approximately equal to a time T1(2) between formation of the second dot D1(2) and a third dot D1(3). In other words, the time between formation of an (m−1)-th dot D1(*m*−1) (where in is an integer) and an m-th dot D1(*m*) is approximately the same for any m in period P1.

In a period P2 after deceleration of the tape-feeding motor 24 has begun (timing t11) and until the printing method is switched from synchronous printing to timer printing (timing t22), the tape-feeding motor 24 decelerates from the first speed to the second speed. During this period, the period of pulse signals outputted from the driver circuit 407 to the tape-feeding motor 24 increases over time. Therefore, when synchronous printing is executed during period P2, a time T2(*m*+2) between formation of an (m+2)-th dot D2(*m*+2) and an (m+3)-th dot D2(*m*+3) is longer than a time T2(*m*+1) between formation of an (m+1)-th dot D2(*m*+1) and the (m+2)-th dot D2(*m*+2). In other words, any time T2(N−1) between formation of an (N−1)-th dot D2(N−1) (where N is an integer greater than m) and an N-th dot D2(N) is longer than a time T2(N−2) between formation of the (N−2)-th dot D2(N−2) and an (N−1)-th dot D2(N−1) in period P2.

In a period P3 after the printing method is switched from synchronous printing to timer printing (timing t22), dots are repeatedly formed on the cover film 32A at a regular period. Hence, clots are formed in period P3 at a period equivalent to time T3, beginning with an initial dot D3(1) formed at the time T3 after formation of the last dot D2(N) in period P2 and following with the next dot D3(2) and a plurality of subsequent dots formed repeatedly at the same period of time T3. Here, the time T3 is set shorter than the time T2(N−1) between formation of the (N−1)-th dot D2(N−1) and the N-th dot D2(N) in period P2. Therefore, even when the actual conveying speed increases temporarily due to deflection of the tape-feeding roller 35 (between timings t3 and t4), a plurality of dots are formed on the cover film 32A at a shorter period. T3 than the period used at the end of synchronous printing, thereby suppressing the formation of blank areas (white lines) in the dots.

<Detailed Description of Segment Printing (Print Resuming Control)>

In segment printing in the example described above, the CPU 401 temporarily halts conveyance of the tape and subsequently accelerates the tape-feeding motor 24 in order to resume printing. Here, the time required to accelerate the tape-feeding motor 24 from its halted state to the original first speed is preferably as short as possible in order to reduce the time required for segment printing. Hence, the CPU 401 controls the tape-feeding motor 24 as follows when accelerating the tape-feeding motor 24 from the halted state to the first speed.

Figure 7A:
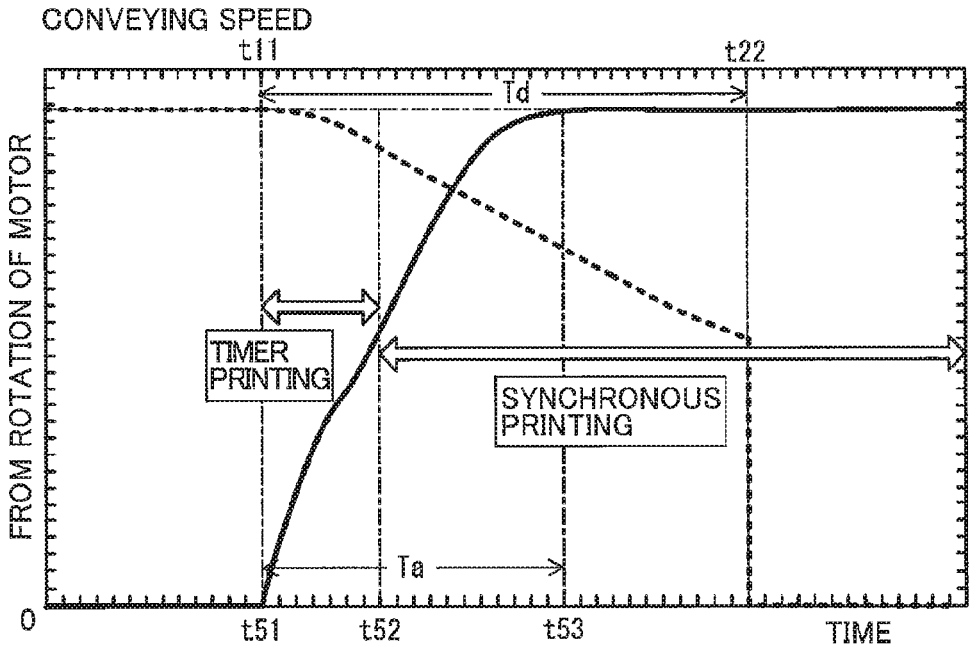
FIG. 7A is a graph showing conveying speed changes over time when printing is resumed.
Figure 7B:
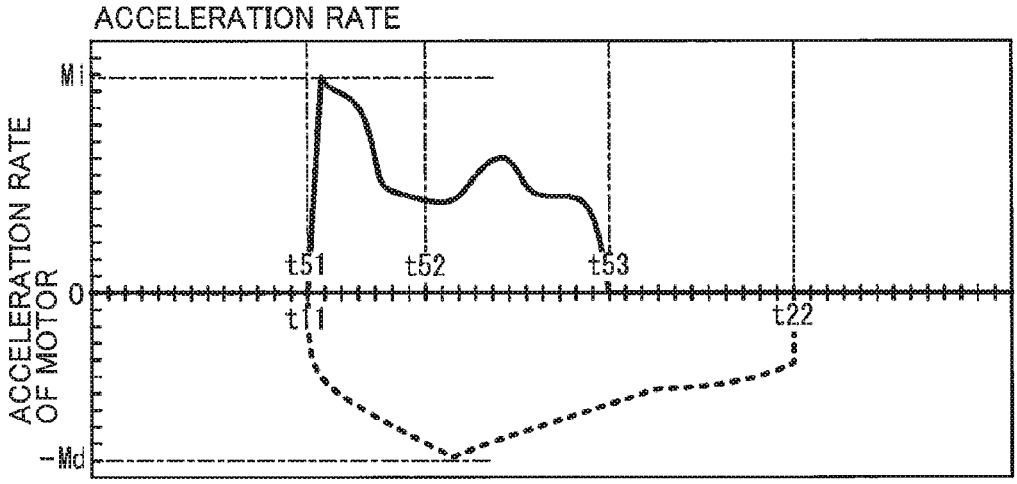
FIG. 7B is a graph showing acceleration rate changes over time when the printing is resumed.

As shown in FIG. 7B, the CPU 401 sets a maximum value Mi for a rate of increase in the rotational speed per unit time of the tape-feeding motor 24 when accelerating the tape-feeding motor 24 from a halted state to the first speed in order to resume printing (hereinafter called the "maximum acceleration value Mi") greater than a maximum value Md for a rate of decrease in the rotational speed per unit time of the tape-feeding motor 24 when decelerating the tape-feeding motor 24 from the first speed to the second speed in order to temporarily halt printing (hereinafter called the "maximum deceleration value Md"). Note that the rate of decrease corresponds to an absolute value of a rate of change in the rotational speed per unit time when the tape-feeding motor 24 decelerates. The rate of increase also corresponds to an absolute value of a rate of change in the rotational speed per unit time when the tape-feeding motor 24 accelerates. By setting the maximum acceleration value Mi greater than the maximum deceleration value Md, the time Ta required for accelerating the tape-feeding motor 24 from the halted state (timing t51) to the first speed (timing t53) (hereinafter called the "acceleration time Ta") is shorter than a time Td required for decelerating the tape-feeding motor 24 from the first speed (timing t11) to the second speed (timing t22) (hereinafter called the "deceleration time Td"), as illustrated in FIG. 7A. With this configuration, the CPU 401 can reduce the time required to accelerate the tape-feeding motor 24 in order to resume printing the tape to a time shorter than that required to decelerate the tape-feeding motor 24 when temporarily halting tape printing.

Note that the CPU 401 controls the rotational speed of the tape-feeding motor 24 as described above based on pulse data for acceleration stored in the flash memory 410. The pulse data for acceleration specifies the period of pulse signals to be outputted to the tape-feeding motor 24 via the driver circuit 407 in increments of elapsed time, beginning from when the tape-feeding motor 24 is first accelerated.

Further, the CPU 401 executes timer printing when the rotational speed of the tape-feeding motor 24 is less than the second speed (between timings t51 and t52) and switches the printing method from timer printing to synchronous printing when the rotational speed of the tape-feeding motor 24 is the second speed or greater (beginning from timing t52).

<Process for Normal Printing>

Next, the process for normal printing executed by the CPU 401 of the printing device 1 will be described. During normal printing, the tape-feeding motor 24 is rotated at the first speed. The printing method used in normal printing is synchronous printing. The CPU 401 executes synchronous printing as follows. Specifically, the CPU 401 drives the heating elements in the thermal head 10 via the driver circuit 406 at timing corresponding to the pulse signals outputted to the tape-feeding motor 24 via the driver circuit 407 based on print data read from the flash memory 410. In this way, the CPU 401 can form a plurality of dots on the cover film 32A with regular spacing (refer to period P1 in FIG. 6).

<Print Halting Process>

Next, a print halting process executed by the CPU 401 of the printing device 1 will be described with reference to FIG. 8. The CPU 401 initiates the print halting process when the tape-feeding motor 24 is temporarily halted during normal printing in order to execute segment printing. The CPU 401 reads the print data to be printed up until the tape-feeding motor 24 will be temporarily halted from the flash memory 410.

In S11 the CPU 401 begins decelerating the tape-feeding motor 24. That is, the CPU 401 begins reducing the rotational speed of the tape-feeding motor 24 from the first speed (from timing t11 in FIG. 5B). The CPU 401 specifies periods of pulse signals to be outputted to the tape-feeding motor 24 via the driver circuit 407 based on the pulse data for deceleration stored in the flash memory 410. The CPU 401 outputs pulse signals at the specified period to the tape-feeding motor 24 via the driver circuit 407.

As shown in FIGS. 5B and 5C, while the rotational speed of the tape-feeding motor 24 remains greater than the intermediate speed (between timings t11 and t12 in FIG. 5B), the rate of decrease per unit time of the rotational speed of the tape-feeding motor 24 continuously increases (curve C2 in FIG. 5C). While the rotational speed of the tape-feeding motor 24 is less than the intermediate speed (between timings t12 and t22 in FIG. 5B), the rate of decrease per unit time in the rotational speed of the tape-feeding motor 24 continuously decreases (curve C5 in FIG. 5C). Accordingly, the conveying speed from the rotation of the tape-feeding motor 24 remains substantially equivalent to the actual conveying speed (curve C6 in FIG. 5B).

The CPU 401 also drives the heating elements in the thermal head 10 at timing corresponding to the pulse signals outputted to the tape-feeding motor 24 via the driver circuit 407. After initiating deceleration of the tape-feeding motor 24, the CPU 401 increases the period of pulse signals over time. Hence, as depicted in period P2 of FIG. 6, the spacing of dots formed on the cover film 32A increases with the increase in elapsed time after deceleration of the tape-feeding motor 24 has begun.

Figure 8:
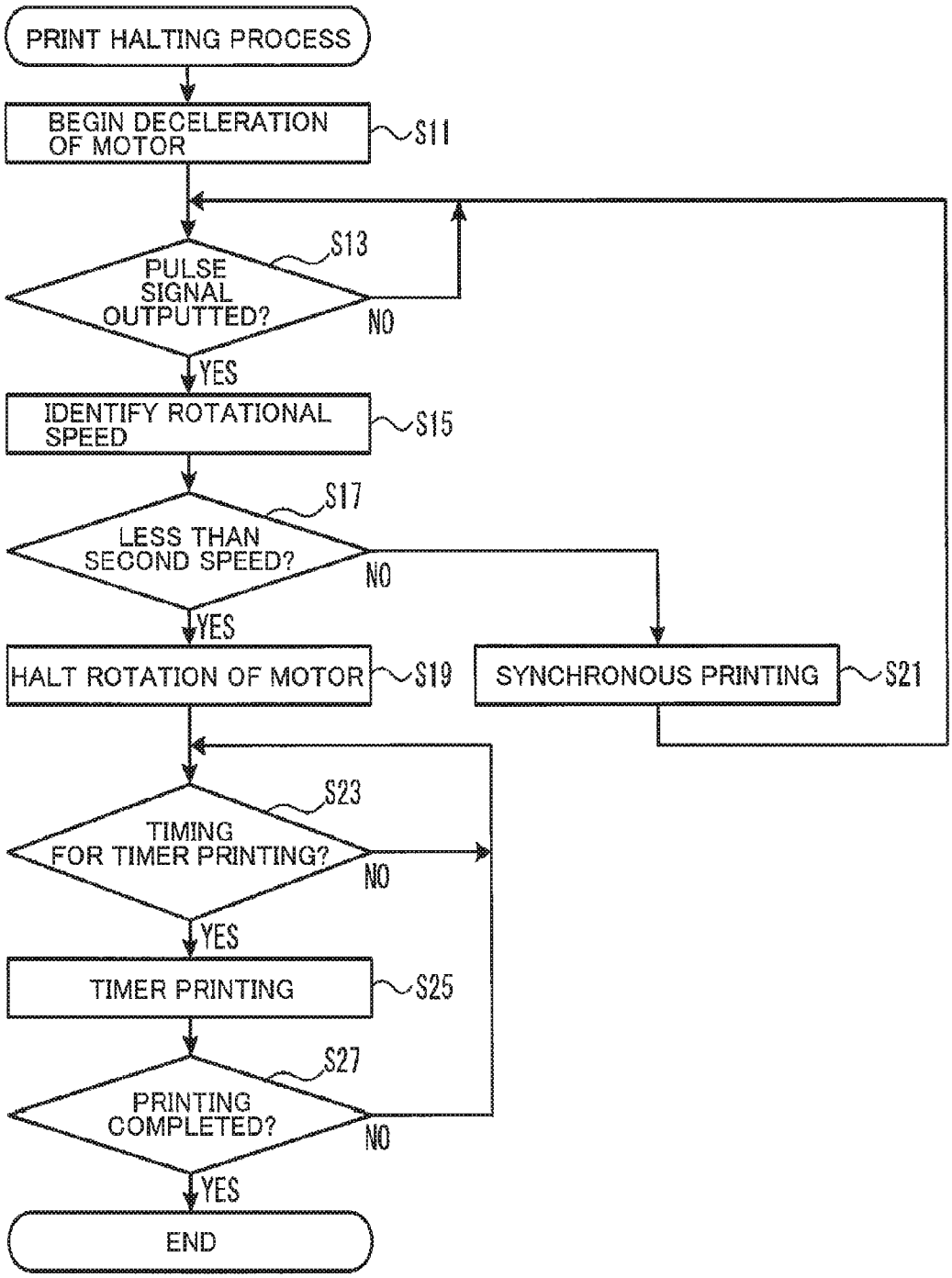
FIG. 8 is a flowchart illustrating steps in a print halting process executed by a CPU in the printing device.

In S13 of FIG. 8, the CPU 401 determines whether a pulse signal was outputted to the tape-feeding motor 24 via the driver circuit 407. The CPU 401 continues to loop back to S13 while a pulse signal has not been outputted (S13: NO). The CPU 401 advances to S15 when a pulse signal has been outputted (S13: YES).

In S15 the CPU 401 identifies the rotational speed of the tape-feeding motor 24 controlled by the pulse signals based on the elapsed time from the previously outputted pulse signal to the currently outputted pulse signal. In S17 the CPU 401 determines whether the identified rotational speed is less than the second speed. The CPU 401 advances to S21 when the rotational speed is greater than or equal to the second speed (S17: NO). In S21 the CPU 401 continuously executes synchronous printing for forming dots on the cover film 32A at timing corresponding to the pulse signals outputted to the tape-feeding motor 24 via the driver circuit 407. Subsequently, the CPU 401 returns to S13.

However, if the CPU 401 determines that the rotational speed identified in S15 is less than the second speed (S17: YES), in S1.9 the CPU 401 halts the tape-feeding motor 24 in an excitation state. Hence, the rotational speed of the tape-feeding motor 24 changes from the second speed to "0" (curve C4 at timing t22 in FIG. 5B).

In S23 the CPU 401 determines whether the time 13 (see FIG. 6) has elapsed since the last dot was printed in synchronous printing. Here, time T3 is the period used for timer printing. The CPU 401 continually loops back to S23 while the time T3 has not elapsed (S23: NO). The CPU 401 advances to S25 when determining that the time T3 has elapsed (S23: YES). In S25 the CPU 401 drives the thermal head 10 via the driver circuit 406 to print dots on the cover film 32A according to timer printing.

In S27 the CPU 401 determines whether all printing has been completed for the print data read from the flash memory 410 at the beginning of the print halting process. The CPU 401 returns to S23 when determining that printing has not been completed (S27: NO) and repeats the timer printing process to form dots on the cover film 32A at periods equivalent to the time T3. When the CPU 401 determines that printing has been completed for all print data read from the flash memory 410 (S27: YES), the print halting process ends.

<Print Starting Process>

Next, a print starting process executed by the CPU 401 of the printing device 1 will be described. The CPU 401 begins the print starting process based on a program stored in the flash memory 410 in order to restart the rotation of the tape-feeding motor 24 after temporarily halting the tape-feeding motor 24 during segment printing. In other words, the print starting process begins after the CPU 401 has executed the print halting process of FIG. 8. Print data to be printed after restarting rotation of the tape-feeding motor 24 is read from the flash memory 410.

Figure 9:
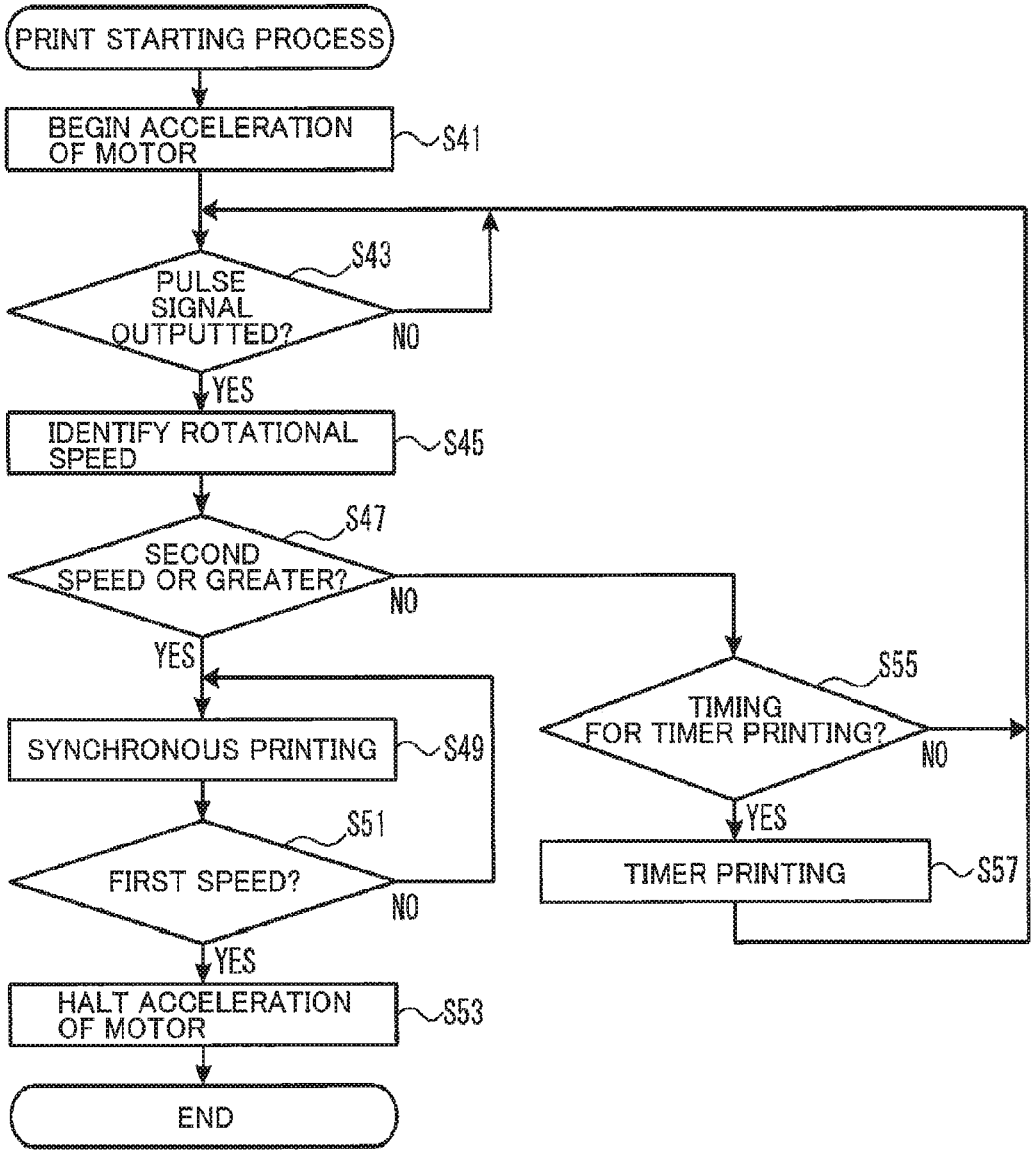
FIG. 9 is a flowchart illustrating steps in a print starting process executed by the CPU.
Figure 10:
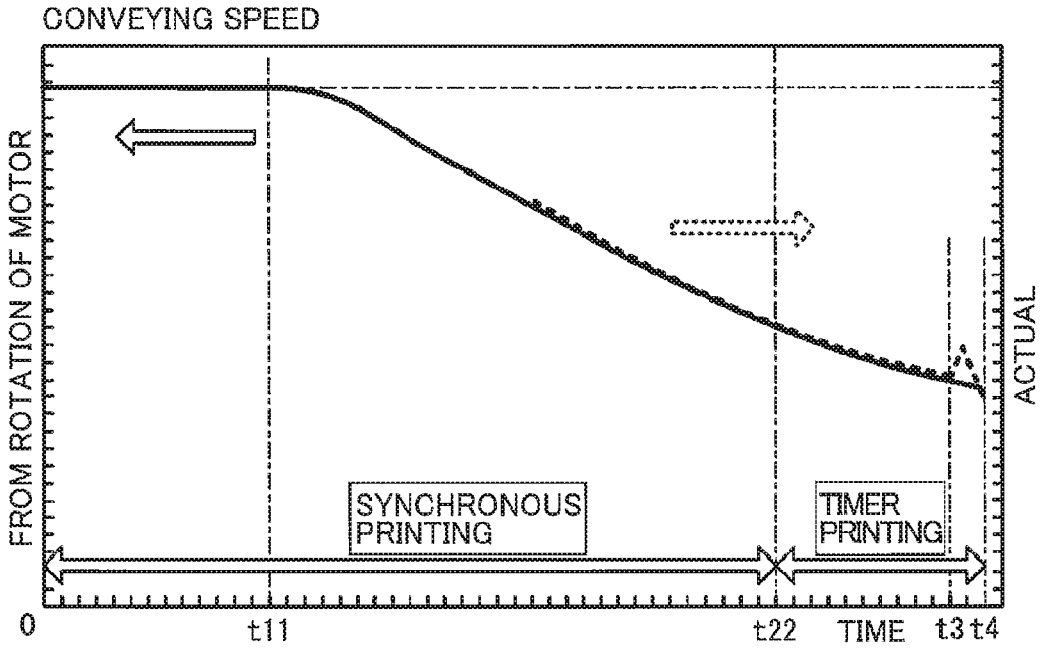
FIG. 10 is a graph showing conveying speed changes over time when rotational speed of a tape-feeding motor in a printing device according to variation is controlled.

In S41 of FIG. 9, the CPU 401 begins accelerating the tape-feeding motor 24. Here, the tape-feeding motor 24 begins accelerating from a halted state (from timing t51 in FIG. 7A). The CPU 401 identifies the period of pulse signals to be outputted to the tape-feeding motor 24 via the driver circuit 407 based on the pulse data for acceleration stored in the flash memory 410. The CPU 401 outputs pulse signals at this identified period to the tape-feeding motor 24 via the driver circuit 406.

In S43 the CPU 401 determines whether a pulse signal was outputted to the tape-feeding motor 24 via the driver circuit 407. The CPU 401 continually loops back to S43 while a pulse signal has not been outputted (S43: NO). The CPU 401 advances to S45 when a pulse signal was outputted (S43: YES).

In S45 the CPU 401 identifies the rotational speed of the tape-feeding motor 24 controlled by the pulse signal based on the elapsed time between the previously outputted pulse signal and the currently outputted pulse signal. In S47 the CPU 401 determines whether the identified rotational speed is greater than or equal to the second speed. The CPU 401 advances to S55 when determining that the rotational speed is less than the second speed (S47: NO). In S55 the CPU 401 determines whether the time T3 (see FIG. 6) has elapsed since the last dot was printed. Here, the time T3 is the period used in timer printing. The CPU 401 returns to S43 when determining that the time T3 has not elapsed (S55: NO) and advances to S57 when determining that the time T3 has elapsed (S55: YES). In S57 the CPU 401 drives the thermal head 10 via the driver circuit 406 in order to print dots on the cover film 32A according to timer printing. Through this process, timer printing is executed at periods equivalent to the time T3 while the rotational speed of the tape-feeding motor 24 is less than the second speed.

When the CPU 401 determines that the rotational speed identified in S45 is greater than or equal to the second speed (S47: YES), the CPU 401 advances to S49. In S49 the CPU 401 drives the heating elements in the thermal head 10 at timing corresponding to the pulse signals outputted to the tape-feeding motor 24 via the driver circuit 407, thereby executing synchronous printing for forming dots on the cover film 32A at timing corresponding to the pulse signals. Hence, the CPU 401 executes timer printing while the rotational speed of the tape-feeding motor 24 is less than the second speed and executes synchronous printing when the rotational speed of the tape-feeding motor 24 is the second speed or greater.

In S51 the CPU 401 determines whether the rotational speed identified in S45 is the first speed. The CPU 401 returns to S49 when determining that the rotational speed is less than the first speed (S51: NO). In S49 the CPU 401 continues performing synchronous printing. If the CPU 401 determines that the identified rotational speed is the first speed (S51: YES), in S53 the CPU 401 halts acceleration of the tape-feeding motor 24 and continues to rotate the tape-feeding motor 24 at the first speed. Subsequently, the CPU 401 ends the print starting process.

After completing the print starting process described above, the CPU 401 executes normal printing. In normal printing, the CPU 401 executes synchronous printing while rotating the tape-feeding motor 24 at the first speed.

Operations and Effects of the Embodiment

As described above, in S11 the CPU 401 of the printing device 1 decelerates the tape-feeding motor 24 that rotates the tape-feeding roller 35 from the first speed in order to temporarily halt printing in a segment printing process. Until the rotational speed of the tape-feeding motor 24 drops below the second speed (S17: NO), in S21 the CPU 401 continuously executes synchronous printing. Here, there is little difference between the conveying speed from the rotation of the tape-feeding motor 24 and the actual conveying speed when the rotational speed of the tape-feeding motor 24 is at least the second speed. Hence, by executing synchronous printing during this period, the CPU 401 can vary the period at which dots are transferred onto the cover film 32A based on the rotational speed of the tape-feeding motor 24. Accordingly, the CPU 401 can form dots on the cover film 32A with substantially uniform spacing in the conveying direction.

However, when the rotational speed of the tape-feeding motor 24 becomes less than the second speed (S17: YES), in S23 and S25 the CPU 401 switches the printing method from synchronous printing to timer printing and executes tinier printing. Here, the difference between the conveying speed from the rotation of the tape-feeding motor 24 and the actual conveying speed may be large when the rotational speed of the tape-feeding motor 24 is less than the second speed (between timings t3 and t4, for example). Hence, by executing timer printing during this period, the CPU 401 can set a uniform period for transferring dots onto the cover film 32A that is independent of the rotational speed of the tape-feeding motor 24. Accordingly, the CPU 401 can suppress the generation of blank areas (white lines) in the dot pattern formed on the cover film 32A, even when the conveying speed from the rotation of the tape-feeding motor 24 differs from the actual conveying speed. In this way, the CPU 401 can identify appropriate timing for switching from synchronous printing to timer printing and can switch the printing method at this timing.

When the rotational speed of the tape-feeding motor 24 becomes less than the second speed (S17: YES), in S19 the CPU 401 halts the rotation of the tape-feeding motor 24. With this action, the CPU 401 minimizes the conveying speed of tape during timer printing. Thus, timer printing is executed while conveyance of the tape is in a stable state. In this way, the CPU 401 can maintain a uniform printing quality through timer printing by stabilizing the conveyance state of the tape when transferring dots during timer printing.

When the rotational speed of the tape-feeding motor 24 becomes less than the second speed (S17: YES), in S19 the CPU 401 halts the tape-feeding motor 24 in an excitation state. In this case, the CPU 401 can reliably halt the rotation of the rotational shaft in the tape-feeding motor 24. Hence, the CPU 401 can suppress tape conveyance caused by the rotational shaft in the tape-feeding motor 24 rotating despite the output of pulse signals to the tape-feeding motor 24 being halted.

The CPU 401 can set the acceleration time Ta for accelerating the tape-feeding motor 24 from the halted stated to the first speed in order to resume printing to a value shorter than the deceleration time Td for decelerating the tape-feeding motor 24 to the second speed in order to temporarily halt printing (see FIG. 7). By reducing the time required for resuming printing after temporarily halting printing, the CPU 401 can reduce the time required for segment printing. Further, the CPU 401 sets the maximum acceleration value Mi for the rate of increase in rotational speed per unit time when accelerating the tape-feeding motor 24 from the halted state to the first speed to a value greater than the maximum deceleration value Md for the rate of decrease in rotational speed per unit time when decelerating the tape-feeding motor 24 from the first speed to the second speed. Accordingly, the CPU 401 can easily reduce the acceleration time Ta to a time shorter than the deceleration time Td.

When switching to timer printing after printing dots the N-th time (where N is an integer) in synchronous printing, the time between printing the N-th dot and printing the initial dot in timer printing can be set shorter than the time between printing the (N−1)-th dot and printing the N-th dot through synchronous printing. With this method, a plurality of dots can be formed on the cover film 32A at a shorter period than that used at the end of synchronous printing, even when the actual conveying speed temporarily increases due to deflection of the tape-feeding roller 35. Therefore, the CPU 401 can suppress the formation of blank areas (white lines) among the dots formed on the cover film 32A.

Variations of the Embodiment

While the description has been made in detail with reference to specific embodiment, it would be apparent to those skilled in the art that many modifications and variations may be made therein without departing from the spirit of the above described embodiment, the scope of which is defined by the attached claims. For example, the method of controlling speed when decelerating the tape-feeding motor 24 (curve C6 in FIG. 5B) is not limited to the example in the embodiment. As an alternative, the CPU 401 may detect the tape conveying speed and may control the rotational speed of the tape-feeding motor 24 based on this detected conveying speed such that the actual conveying speed does not diverge from the conveying speed from the rotation of the tape-feeding motor 24. The CPU 401 may execute synchronous printing after initiating deceleration of the tape-feeding motor 24 by performing the same control used for normal printing. Further, the printing device 1 may allow a user to set the first speed through input on the functional key group 4. The CPU 401 may then set the second speed based on the inputted first speed and may execute the print halting process based on this second speed. The printing device 1 may also be configured to allow a user to set the period for transferring dots in timer printing through input on the functional key group 4. The CPU 401 may execute timer printing based on this inputted transfer period.

In the print halting process described in the embodiment, after initiating deceleration of the tape-feeding motor 24 in S11, the CPU 401 halts rotation of the tape-feeding motor 24 in S19 when the rotational speed of the tape-feeding motor 24 becomes slower than the second speed (S17: YES). However, the CPU 401 may set different values for the target rotational speed to be used for comparison with the rotational speed of the tape feeding motor 24 in the process of S17 (hereinafter called the "comparative speed") and the final rotational speed of the tape-feeding motor 24 following deceleration (second speed). In this case, the comparative speed may be set to the same value as the second speed used in the embodiment described above, while the second speed may be set smaller than the second speed used in the embodiment described above. For example, the second speed may be set to "0". In other words, the CPU 401 may continue decelerating the tape-feeding motor 24 from the first speed to a speed of "0".

In the variation described above, the CPU 401 continues decelerating the tape-feeding motor 24 to the second speed, without halting rotation of the tape-feeding motor 24 when switching the printing method from synchronous printing to timer printing at the point that the rotational speed of the tape-feeding motor 24 drops below the comparative speed. In other words, unlike in the embodiment described above, timer printing is executed while the tape-feeding motor 24 continues to decelerate. In this case, the CPU 401 can reduce the rotational speed of the tape-feeding motor 24 more gradually than in the embodiment described above since the rotational speed of the tape-feeding motor 24 is continuously reduced. Therefore, the CPU 401 can achieve more stable control of the rotational speed of the tape-feeding motor 24 than in the example of the embodiment.

In the embodiment described above, the CPU 401 identifies the rotational speed of the tape-feeding motor 24 in S15 based on the time elapsed between the previously time a pulse signal was outputted to the tape-feeding motor 24 via the driver circuit 407 and the currently outputted pulse signal. The CPU 401 then determines the timing for switching from synchronous printing to timer priming by comparing the rotational speed identified in S15 to the second speed in S17. However, the CPU 401 may instead determine timing for switching from synchronous printing to timer printing by comparing the elapsed time between the previously outputted pulse signal and currently outputted pulse signal to a prescribed time. Specifically, the CPU 401 may execute synchronous printing while the elapsed time is shorter than the prescribed time (S17: NO) and may switch from synchronous printing to timer printing when the elapsed time is greater than or equal to the prescribed time (S17: YES).

Further, the CPU 401 may halt rotation of the tape-feeding motor 24 in the process of S19 without exciting the tape-feeding motor 24. In other words, the CPU 401 may halt the tape-feeding motor 24 by halting the supply of electricity to the tape-feeding motor 24.

In the embodiment described above, the CPU 401 sets the acceleration time Ta for accelerating the tape-feeding motor 24 shorter than the deceleration time Td for decelerating the tape-feeding motor 24. However, the CPU 401 may set the deceleration time Td and acceleration time Ta substantially equal to each other or set the deceleration time Td shorter than the acceleration time Ta. Further, the CPU 401 in the embodiment described above sets the maximum acceleration value Mi for accelerating the tape-feeding motor 24 greater than the maximum deceleration value Md for decelerating the tape-feeding motor 24. However, the CPU 401 may set the maximum deceleration value Md and maximum acceleration value Mi substantially equal to each other or may set the maximum deceleration value Md greater than the maximum acceleration value Mi.

When switching to timer printing after printing dots the N-th time (where N is an integer) in synchronous printing, the CPU 401 may set the time between printing the N-th dot in synchronous printing and printing the initial dot in tinier printing substantially equal to the time between printing the (N−1)-th dot and printing the N-th dot in synchronous printing. Alternatively, the CPU 401 may set the time between printing the N-th dot in synchronous printing and printing the initial dot in timer printing longer than the time between printing the (N−1)-th dot and printing the N-th dot in synchronous printing.

What is claimed is:

1. A printing device comprising:

a roller for conveying a printing medium in a conveying direction;

a stepper motor configured to rotate in synchronization with a pulse signal and rotate the roller;

a head configured to perform printing on the printing medium conveyed by the roller; and a controller configured to perform:

decelerating the stepper motor from a first speed to a second speed;

identifying a rotational speed of the stepper motor during deceleration of the stepper motor;

performing synchronous printing in which the head is driven at timing in synchronization with the pulse signal when the rotational speed is greater than or equal to a prescribed speed; and performing timer printing in which the head is driven at a prescribed period when the rotational speed is less than the prescribed speed.

2. The printing device according to claim 1, wherein the second speed is equal to the prescribed speed;

wherein the controller is further configured to perform halting rotation of the stepper motor when the rotational speed is less than the prescribed speed; and wherein the performing timer printing is performed after the rotation of the stepper motor is halted.

3. The printing device according to claim 2, wherein the rotation of the stepper motor is halted under an excitation state of the stepper motor.

4. The printing device according to claim 2, wherein the controller is further configured to perform accelerating the stepper motor from a halted state to the first speed after the rotation of the stepper motor is halted; and wherein acceleration time required for accelerating the stepper motor from the halted state to the first speed is shorter than deceleration time required for decelerating the stepper motor from the first speed to the second speed.

5. The printing device according to claim 4, wherein a maximum deceleration value for a rate of decrease in the rotational speed per unit time when the decelerating decelerates the stepper motor from the first speed to the second speed is smaller than a maximum acceleration value for a rate of increase in the rotational speed per unit time when the accelerating accelerates the stepper motor from the halted state to the first speed.

6. The printing device according to claim 1, wherein the second speed is less than the prescribed speed; and wherein the performing timer printing is performed during the deceleration of the stepper motor.

7. The printing device according to claim 1, wherein the performing synchronous printing forms N-number dots in the conveying direction and the performing timer printing forms an (N+1)-th dot in the conveying direction after an N-th dot is formed, N being an integer greater than 1; and wherein a first time from formation of an (N−1)-th dot to formation of the N-th dot is shorter than a second time from formation of the N-th dot to formation of the (N+1)-th dot.

* * * * *